US006438784B1

(12) United States Patent
Yu

(10) Patent No.: US 6,438,784 B1
(45) Date of Patent: Aug. 27, 2002

(54) CLEANING DEVICE WITH REPLACEABLE HEAD

(76) Inventor: Chih-Hsin Yu, 4F-3, No. 123, Lane 235, Pao Chiao Rd., Hsin Tien City (TW)

( * ) Notice: Subject to any disclaimer, the term of this patent is extended or adjusted under 35 U.S.C. 154(b) by 78 days.

(21) Appl. No.: 09/672,996

(22) Filed: Sep. 29, 2000

(51) Int. Cl.[7] ..... A46B 7/04; A47L 13/12

(52) U.S. Cl. ..... 15/106; 15/105; 15/111; 15/114; 15/145; 15/176.1; 15/176.6; 16/422; 16/DIG. 41; 403/348; 403/349

(58) Field of Search ..... 15/105, 106, 111, 15/114, 115, 118, 144.1, 145, 172, 176.1, 176.6, 202; 16/422, DIG. 41; 403/348, 349

(56) References Cited

U.S. PATENT DOCUMENTS

| | | | | | |
|---|---|---|---|---|---|
| 695,353 | A | * | 3/1902 | Turner | 403/349 X |
| 702,998 | A | * | 6/1902 | Randolph | 15/115 |
| 1,879,553 | A | * | 9/1932 | Silva et al. | 15/176.1 |
| 1,932,099 | A | * | 10/1933 | Cabana | 16/422 X |
| 2,444,758 | A | * | 7/1948 | Stillbach | 15/145 |
| 2,527,256 | A | * | 10/1950 | Jackson | 403/349 X |
| 3,423,781 | A | * | 1/1969 | Henson | 15/145 |
| 5,479,673 | A | * | 1/1996 | Carton | 15/111 |
| 5,915,482 | A | * | 6/1999 | Carruthers | 403/348 X |

FOREIGN PATENT DOCUMENTS

| | | | | |
|---|---|---|---|---|
| FR | 676374 | * | 2/1930 | 403/349 |
| FR | 2527280 | * | 11/1983 | 403/349 |
| GB | 16504 | * | 7/1912 | 403/349 |
| IT | 303894 | * | 12/1932 | 15/145 |

* cited by examiner

*Primary Examiner*—Mark Spisich
(74) *Attorney, Agent, or Firm*—Bacon & Thomas, PLLC

(57) ABSTRACT

A cleaning device. The device includes a hollow shank having a first guide member at a front end and a second guide member joined with and perpendicular to the first guide member. A head is releasably coupled to the front portion of the shank. The head includes a longitudinal bar having an engagement member on the surface at the rear end. The engagement member is guided along the first guide member to move to the end prior to being rotated a predetermined angle about the shank clockwise or counterclockwise so as to urge against either end of the second guide member for securing the shank to the head. A first cleaning member is on one side of the head, and a sleeve put on the joint of the bar of the head and the front portion of the shank. This cleaning device with replaceable head can reduce the manufacturing cost and storing space.

3 Claims, 3 Drawing Sheets

CLEANING DEVICE WITH REPLACEABLE HEAD

FIELD OF THE INVENTION

The present invention relates to brushes and more particularly to a cleaning device having replaceable head with improved characteristics.

BACKGROUND OF THE INVENTION

Conventionally, cleaning devices such as brushes are widely used in our daily life. It is also known that a variety of commercially available brushes are designed for their respective specific cleaning purposes only.

A conventional brush comprises a head with a plurality of rows of bristles fastened thereinto, an elongate shank extended from the head, and a handle coupled to rear end of shank. In a typical manufacturing process, it is first to manufacture a head with specific bristles fastened thereinto. Then integrally form the head with shank and handle to produce a single purpose brush.

However, the previous design suffered from several disadvantages. For example, in manufacturing two different types of brushes in a mass production it is required to manufacture a first specific head, a shank, and a handle in a first manufacturing process prior to integrally form them together, while manufacturing a second specific head, the common shank, and the common handle in a second manufacturing process prior to integrally form them together. In view of above, it is quite time consuming and cost ineffective to manufacture the common shank and handle. Also, user has to buy a variety of such brushes for respective purpose. This is a great burden to an ordinary people. Further, user has to prepare a space to store such brushes. It quite annoys the user if such space is not easy to find. In view of above, such typical brushes are disadvantageous.

Thus, it is desirable to provide an improved cleaning device with replaceable head in order to overcome the above drawbacks of prior art.

SUMMARY OF THE INVENTION

It is an object of the present invention to provide a cleaning device comprising a hollow shank including a first guide member at the front end and a second guide member joined with and perpendicular to the first guide member, a head releasably coupled to the front portion of the shank, the head including a longitudinal bar having an engagement member on the surface at the rear end, the engagement member being guided along the first guide member to move to the end prior to being rotated a predetermined angle about the shank clockwise or counterclockwise so as to urge against either end of the second guide member for securing the shank the head, a first cleaning means on one side of the head, and a sleeve put on the joint of the bar of the head and the front portion of the shank. This cleaning device with replaceable head can reduce the manufacturing cost and storing space.

The above and other objects, features and advantages of the present invention will become apparent from the following detailed description taken with the accompanying drawings.

DETAILED DESCRIPTION OF THE PREFERRED EMBODIMENTS

Figure 1:
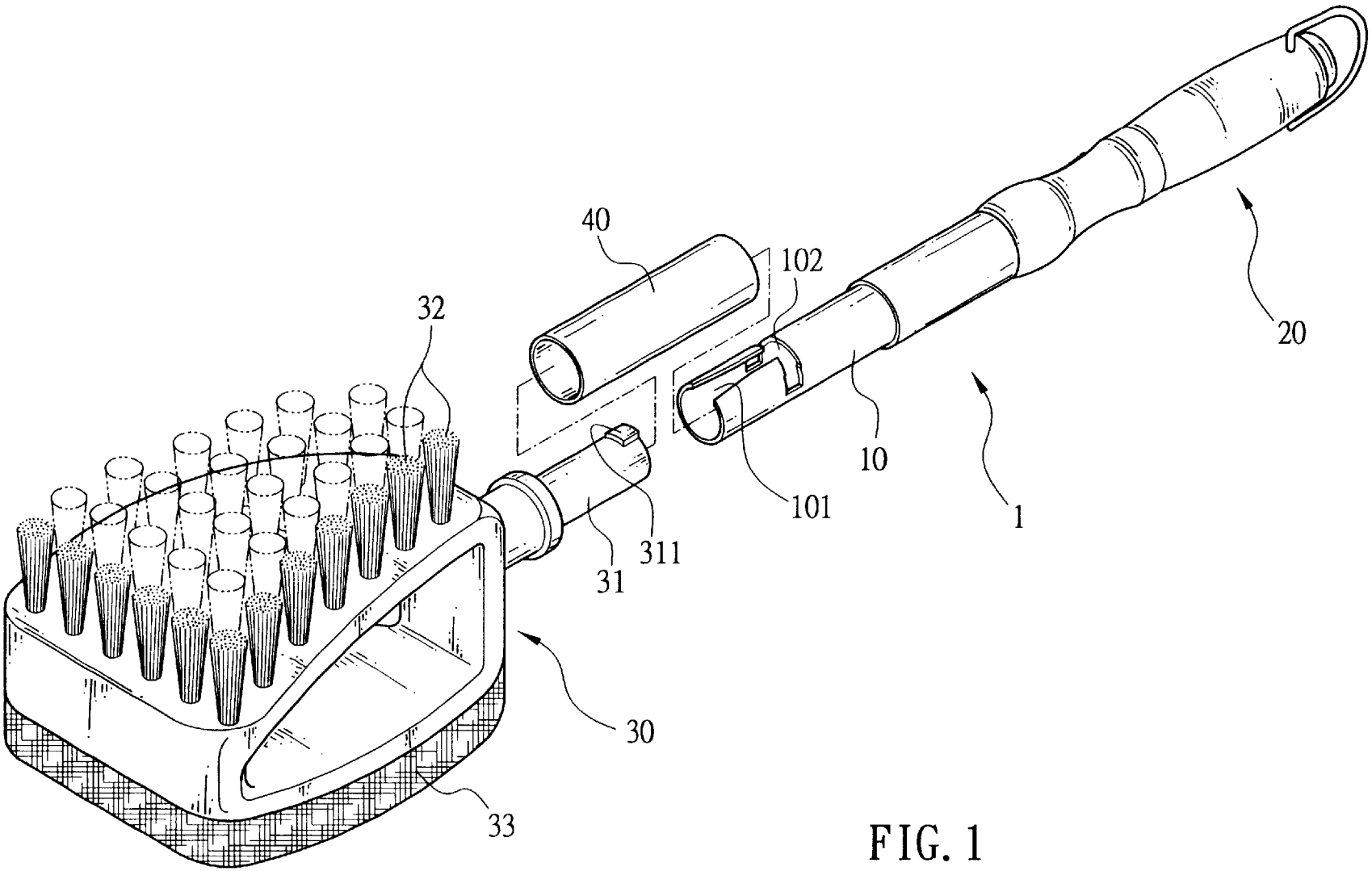
FIG. 1 is an exploded perspective view of a first preferred embodiment of a brush with replaceable head according to the invention.
Figure 2:
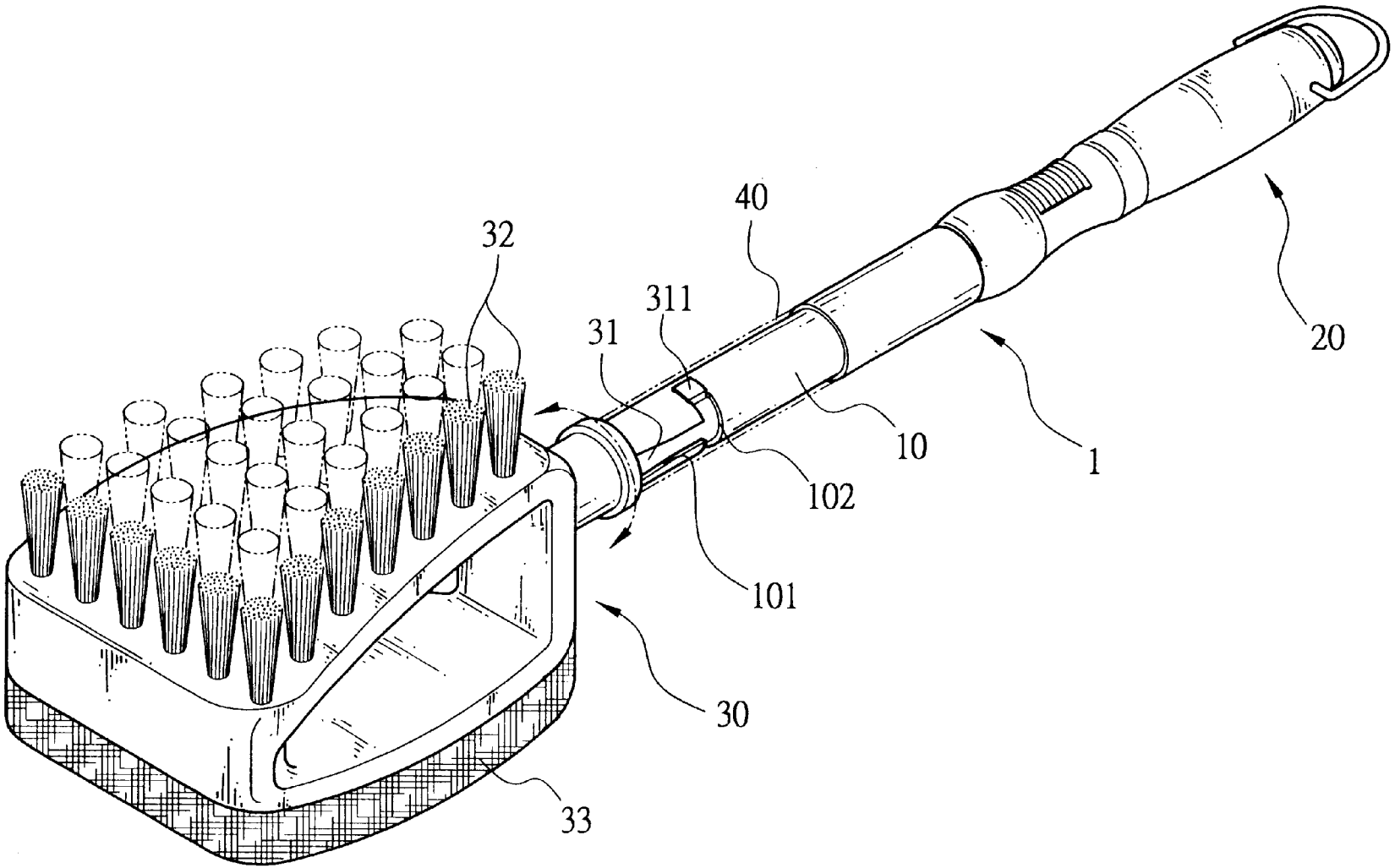
FIG. 2 is a perspective view of the assembled FIG. 1 brush.

Referring to FIGS. 1 and 2, there is shown a brush 1 constructed in accordance with the invention comprising a head 30, a hollow shank 10, and a handle 20. Each of above components is described below.

Shank 10 comprises a first guide member 101 at the front end and a second guide member 102 perpendicular to the first guide member 101 at the center. As shown, first guide member 101 is a longitudinally extended groove on the outer surface and, second guide member 102 is a transversely extended groove. It is appreciated by those skilled in the art that such groove may be replaced by any of other suitable members without departing from the scope and spirit of the invention. Also, the rear end of shank 10 is coupled to handle 20.

A multi-functional head 30 is releasably coupled to the front end of shank 10. Head 30 comprises a longitudinal bar 31 which has an engagement member 311 on the surface near the rear end thereof. As shown, engagement member 311 is a raised member. It is appreciated by those skilled in the art that such raised member may be replaced by any of other suitable members without departing from the scope and spirit of the invention. Engagement member 311 may be guided along the first guide member 101 to move to the end. At this position, engagement member 311 may be rotated a predetermined angle about shank 10 clockwise or counterclockwise so as to urge against either end of second guide member 102. Thus, shank 10 is secured to the head 30. With this rotation, it is possible to turn the top side or the underside of head 30 to face the object to be cleaned.

In this embodiment, the top side of head 30 are a plurality of rows of cleaning means (e.g., bristles) 32 fastened thereinto, while the underside is scrubber 33. It is appreciated by those skilled in the art that such scrubber may be replaced by any of other suitable members without departing from the scope and spirit of the invention. In use, rotate engagement member 311 a predetermined angle about shank 10 clockwise or counterclockwise so as to urge against either end of second guide member 102. With this rotation, it is possible to turn the top side or the underside of head 30 to face the object to be cleaned. Thus, user may hold handle 20 to clean the desired object conveniently.

A sleeve 40 is further provided by the invention. Sleeve 40 is put on the joint of bar 31 of head 30 and the front portion of shank 10. As such, the engagement of head 30 and shank 10 may be enhanced by the provision of sleeve 40.

Figure 3:
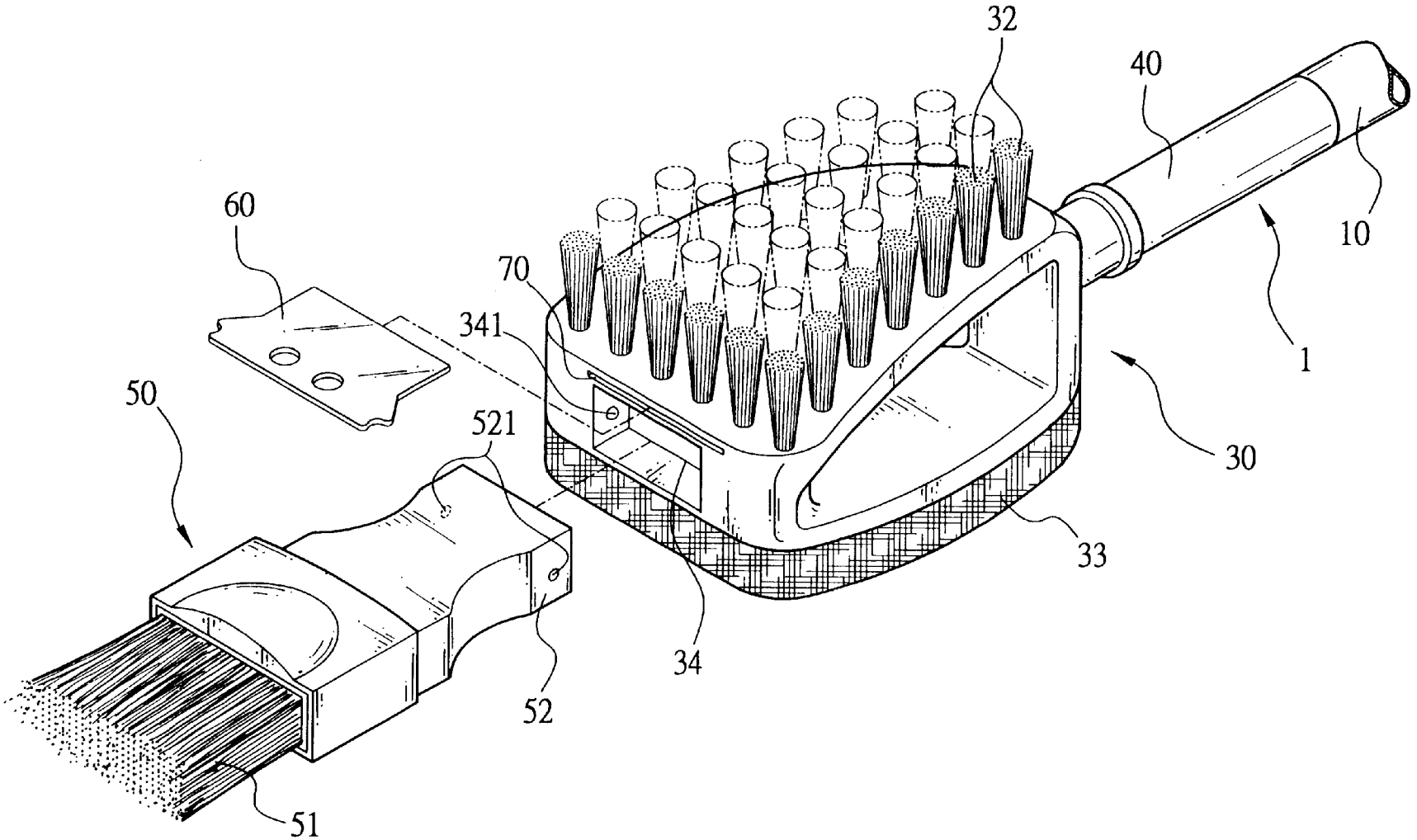
FIG. 3 is a partial exploded perspective view of a second preferred embodiment of a brush with replaceable head according to the invention.

Referring to FIG. 3, a second embodiment is illustrated. As shown, a front recess 34 is formed in head 30. A first detent 341 is provided on either side of recess 34. First detent 341 is a raised member in this embodiment. It is appreciated by those skilled in the art that such raised member may be replaced by any of other suitable members without departing from the scope and spirit of the invention. Another brush 50 is snapped in the recess 34. Brush 50 comprises a plurality of bristles 51 at the front end and an engagement section 52 at the rear end having a second detent 521 on either side. In this embodiment, second detent 521 is a dent so as to be matingly engaged with first detent 341 when securing the brush 50 in the recess 34.

A blade-like metallic plate 60 is snapped in a slit 70 adjacent the top of recess 34. It is possible to clean the hard dirt by this plate 60.

In brief, the head 30 of the invention is replaceable. Thus, a variety of cleaning means may be mounted on head 30. With this, the drawbacks of prior art such as time consuming and cost ineffective by manufacturing integral head, shank, and handle of a single purpose cleaning device, and space consuming in storing a variety of cleaning devices are eliminated.

While the invention has been described by means of specific embodiments, numerous modifications and variations could be made thereto by those skilled in the art without departing from the scope and spirit of the invention set forth in the claims.

What is claimed is:

1. A cleaning device comprising:

a hollow shank including a first guide member at a front end thereof and a second guide member joined with and perpendicular to the first guide member;

a head releasably coupled to a front potion of the shank, the head including a longitudinal bar having an engagement member on a surface at a rear end thereof, the engagement member being guided along the first guide member to move end of the first guide member prior to being rotated at a predetermined angle about the shank clockwise or counterclockwise so as to urge against either end of the second guide member for securing the shank to the head;

a first cleaning device on one side of the head;

a sleeve put on the joint of the bar of the head and the front portion of the shank; and wherein the head further comprises a front recess and a first detent on either side of the recess, the cleaning device comprises a brush including a plurality of bristles at a front end thereof and an engagement section at a rear end thereof having a second detent on either side thereof being matingly engaged with the first detent when the brush is snapped in the recess.

2. The cleaning device of claim 1, wherein the first detent is a raised member and the second detent is a dent.

3. The cleaning device of claim 1, further comprising a blade-shaped metallic plate snapped in a position adjacent the top of the recess for cleaning hard dirt.

* * * * *